US005417082A

United States Patent [19]

Foster et al.

[11] Patent Number: 5,417,082

[45] Date of Patent: May 23, 1995

[54] CONSTANT TEMPERATURE CONTAINER

[75] Inventors: Eugene L. Foster; Mavis H. Foster, both of Alexandria, Va.

[73] Assignee: UTD Incorporated, Newington, Va.

[21] Appl. No.: 910,878

[22] Filed: Jul. 9, 1992

[51] Int. Cl.[6] ..... F25D 3/08

[52] U.S. Cl. ..... 62/457.1; 165/96

[58] Field of Search ..... 62/457.1, 457.2, 457.7, 62/457.9, 332; 165/30, 32, 96

[56] References Cited

U.S. PATENT DOCUMENTS

| | | | |
|---|---|---|---|
| 1,451,823 | 4/1923 | Hampton et al. | 62/457.1 X |
| 2,512,437 | 6/1950 | Pike | 62/332 X |
| 2,760,345 | 8/1956 | Woods | 62/332 X |
| 2,915,235 | 12/1959 | Rueckert | 62/457.1 X |
| 4,341,091 | 7/1982 | Minter | 62/457.1 X |
| 4,502,295 | 3/1985 | Toledo-Pereyra | 62/457.1 X |
| 4,509,587 | 4/1985 | Clark et al. | 62/457.1 X |
| 4,958,506 | 9/1990 | Guilhem et al. | 62/457.2 |

*Primary Examiner*—William E. Tapolcai

*Attorney, Agent, or Firm*—Dickstein, Shapiro & Morin

[57] ABSTRACT

An insulated container for maintaining a product at a specific constant temperature during shipping or storage using two constant temperature coolants of different temperatures on either side of a highly conductive product storage box to establish a temperature gradient. Two pieces of insulated material of different thicknesses are placed between the product storage box and the constant temperature coolants. The selected thicknesses of the insulated material determine the specific temperature of the product, which will be between the temperatures of the two constant temperature coolants. U-shaped heat equalizers are disposed around the insulated material to conduct ambient heat leakage directly to the coolants and thereby help to insure a uniform temperature throughout the product storage box.

34 Claims, 3 Drawing Sheets

CONSTANT TEMPERATURE CONTAINER

BACKGROUND OF THE INVENTION

1. Technical Field of the Invention

The present invention relates to a container for maintaining an object at a specific temperature other than the ambient temperature of the environment. More specifically, this invention relates to a container which uses two materials which maintain respective different temperatures in an insulated container for establishing a temperature gradient in the container and means for maintaining an object at a constant, selected temperature between the two different temperatures during shipping or short term storage.

2. Discussion of the the Prior Art

For many products, such as foods, drugs, body organs and material samples, it is desirable to maintain a specific constant temperature during transportation or storage. Refrigeration or self-heating containers provide a constant temperature for such products, but tend to be bulky, heavy and complicated to operate. In shipping, especially by air, the substantial weight of a refrigeration or self-heating container adds excessively to the costs. Additionally, refrigerated or heated containers require an external refrigeration or heating source which can be difficult to maintain and operate during shipping. Since containers for maintaining a commodity in a cooled state are by far more prevalent than containers which maintain a commodity in a heated state, the ensuing discussion focuses on refrigerated containers. However, it should be understood that the problems with the prior art and the solution offered by the invention are also applicable to containers for maintaining a commodity in a heated state.

Various insulated shipping containers which use a refrigerant have been devised for shipping. Some approaches, such as those shown in U.S. Pat. Nos. 4,294,079 and 3,971,231, have oriented a product and refrigerant within a specific insulated container in order to maintain a proper temperature.

Generally such insulated containers use ice or dry ice (solid carbon dioxide) as the refrigerant. The use of a single refrigerant in the container with the product limits the possible temperatures at which the product can be maintained. Also, temperature differences occur among products or parts of products which are closer to and farther from the refrigerant in such containers.

Therefore, a need exists for an insulated shipping container which provides a uniform, constant temperature throughout a defined volume. A need also exists for a shipping container which is lightweight, easily transportable and yet maintains an object at the appropriate user-selected constant temperature.

SUMMARY OF THE INVENTION

The present invention alleviates to a great extent the deficiencies of the prior art by providing an insulated container which uses two coolants at different temperatures, such as ice water and dry ice, respectively disposed on opposite sides of an object. The object is separated from both refrigerants by heat regulators of an insulating material of different thicknesses.

In one aspect of the invention, the thicknesses of the insulating material can be varied such that the object is maintained at a specific temperature along a temperature gradient existing between the temperatures of the two coolants. In another aspect of the invention, the object is disposed within a thermally conductive box which maintains a uniform temperature throughout the product.

Therefore, it is an object of this invention to provide a shipping container which can maintain an object at a constant user-selected temperature within a specified range of temperatures. It is another object of the present invention to maintain a uniform temperature throughout the product. It is another object of the present invention to provide a shipping container of reduced weight which maintains the product at the specified constant temperature for an extended period of time.

These and other objects, advantages and features of the invention will become more readily apparent, by reference to the following detailed description of the invention, which is provided in connection with the accompanying drawings.

DETAIL DESCRIPTION OF A PREFERRED EMBODIMENT

Figure 1:
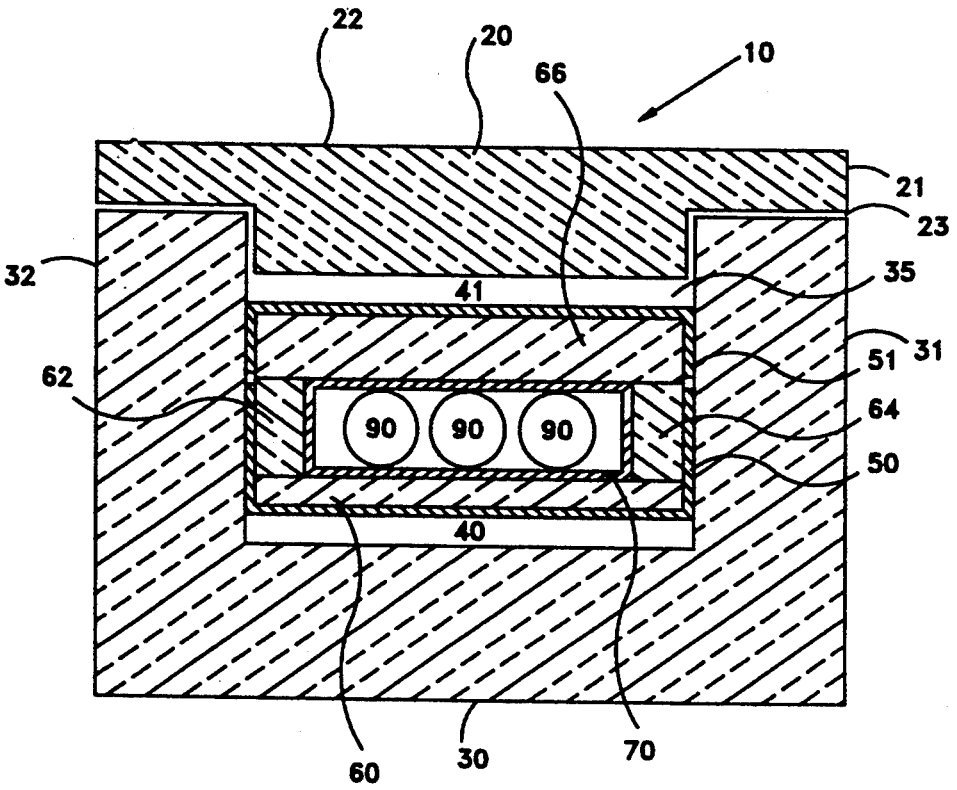
FIG. 1 is a cross-sectional view of a constant temperature container according to a preferred embodiment of the present invention.

Referring now in detail to the drawings, there is illustrated in FIG. 1 a cross-sectional view of an insulated container 10 including a frame 30 and cap 20 of an insulating material such as expanded polystyrene. The frame includes two side walls 31, 32 which, together with the frame 30 and the cap 20, define an inner cavity 35. The cap 20 consists of a narrow peripheral portion 21 which rests on the side walls 31, 32 of frame 30 and an extended portion 22 which protrudes into the inner cavity 35 of the frame 30. The lower portion 40 of the inner cavity 35 is a lower constant temperature source area into which a first coolant is placed, such as a mixture of ice and water. The upper portion 41 of the inner cavity 35 forms an upper constant temperature sink area 41 into which a second coolant of a different temperature, such as dry ice (solid carbon dioxide), is placed. A first U-shaped heat equalizer 50 is disposed adjacent to the lower constant temperature source area 40. Similarly, a second U-shaped heat equalizer 51 is located adjacent to the upper constant temperature sink area 41. The heat equalizers 50, 51 are preferably formed of a good thermally conductive material, such as aluminum. Heat flow regulators 60, 66, formed of an insulating material, e.g., styrene, cellofoam, purethan foam or others, are respectively disposed next to the heat equalizers 50 and 51. A storage box 70, preferably of a good thermally conductive material, such as aluminum, contains an object for shipping. In FIG. 1, the transported objects are illustrated as permafrost core samples 90. The storage box 70 is disposed between the heat flow regulators 60 and 66.

Figure 2:
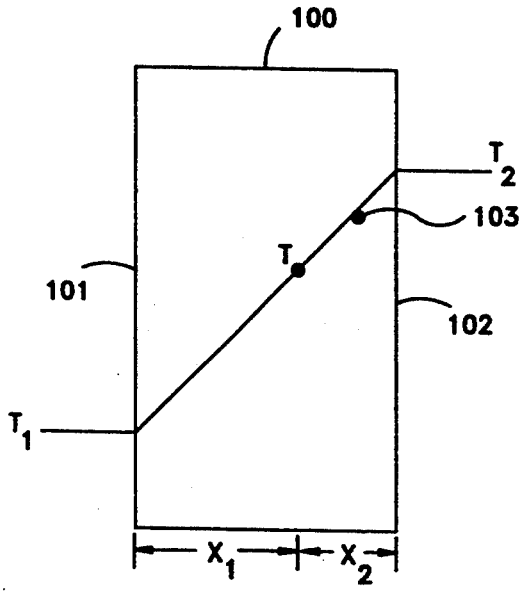
FIGS. 2 and 3 are temperature graphs illustrating the theory of operation of the present invention.

The manner in which a constant temperature for the contents of the storage box 70 can be selected and maintained is described in connection with FIGS. 2 and 3. As shown in FIG. 2, when opposite parallel walls 101, 102 of a sheet of insulation material 100 are maintained at constant, non-equal temperatures $T_1$, $T_2$ a linear temperature gradient 103 is established within the insulation material. The temperature at any point T within the insulation material 100 is determined by the distances $x_1$, $x_2$ of the point from each wall 101, 102.

Figure 3:
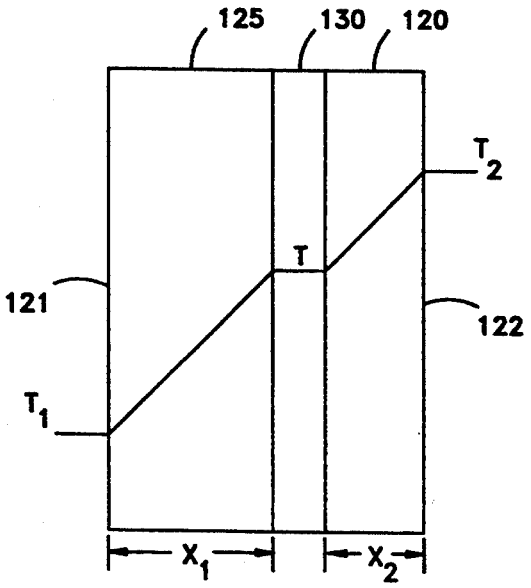

As shown in FIG. 3, a highly thermally conductive material 130, inserted between two pieces 120, 125 of an insulated material with parallel walls 121, 122 maintained at respective constant, non-equal temperatures $T_1$, $T_2$, is maintained at a constant temperature T throughout the thermally conductive material. The constant temperature T of the thermally conductive material 130 is determined by the distances $x_1$, $x_2$ from the parallel walls of the insulation material 121, 122. The temperature T is given by the equation $$T=T_2-[X_2*(T_2-T_1)/(x_1+x_2)]. \quad (1)$$

Therefore, given the constant temperature coolants $T_1$, $T_2$, any temperature T between $T_1$ and $T_2$ can be obtained by selecting different thicknesses $x_1$ and $x_2$ for the insulation materials 120, 125. Equation (1) only applies when the two pieces of insulation material 120, 125 are of the same material. If two different insulation materials are used, the temperature T would then depend on the thermal characteristics of the materials as well as the distances $x_1$, $x_2$ from the parallel walls 121, 122 according to the following equation:

$$T=T_2-(k_1x_2)(T_2-T_1)/(k_2x_1+k_1x_2) \quad (2)$$

where $k_1$, and $k_2$ are constants representing the thermal conductivity of the insulators 125 and 120 respectively. When insulators 120 and 125 are the same $k_1=k_2$ and equation (1) results.

In light of the explanation given in connection with FIGS. 2 and 3, the temperature of the storage box 70 in FIG. 1 is determined by the temperature of the coolants in the upper constant temperature sink area 41 and the lower constant temperature source area 40, and by the thicknesses (and/or materials) of the heat flow regulators 60, 66. Generally, an ice water mixture can be used as the coolant in the lower constant temperature source area 40. An ice water mixture maintains a constant temperature of 32° F. (0° C.) as long as both phases exist together. Dry ice, which maintains a constant sublimation temperature of −112° F. (−80° C.), is used as the coolant in the upper constant temperature sink area 41. To allow for sublimation of the dry ice, small channels 23 are included between the frame 30 and the cap 20 of the insulated container for venting the carbon dioxide gas.

The U-shaped heat equalizers 50, 51, which are of a thermally conductive material, such as aluminum, provide uniform temperatures against the respective faces of heat flow regulators 60, 66 and, as well, cause any heat flow from the outside environment which passes through the side walls 31, 32 of the insulated frame 30 to flow directly to the constant temperature coolant areas 40, 41. The heat equalizers help maintain a uniform temperature in the storage box 70 by preventing heat from the outside environment which passes through side walls 31, 32 from entering the sides of the storage box 70. All heat entering from the outside environment through walls 31, 32 is passed by the heat equalizers 50, 51 to the constant temperature coolant areas 40, 41. A uniform temperature throughout the storage box 70 requires uniform temperatures along the parallel walls of the heat regulators 60, 66. The heat equalizers 50, 51 of a heat conductive material prevent non-uniformity of temperature on the heat regulators 60, 66 due to nonuniform distribution of the coolants. Additionally, spacers 62, 64 of an insulated material maintain the position of the storage box in relation to the heat equalizers and also help maintain the uniform temperature of the storage box 70 by restricting and controlling heat flow between it and the heat equalizers.

Figure 4:
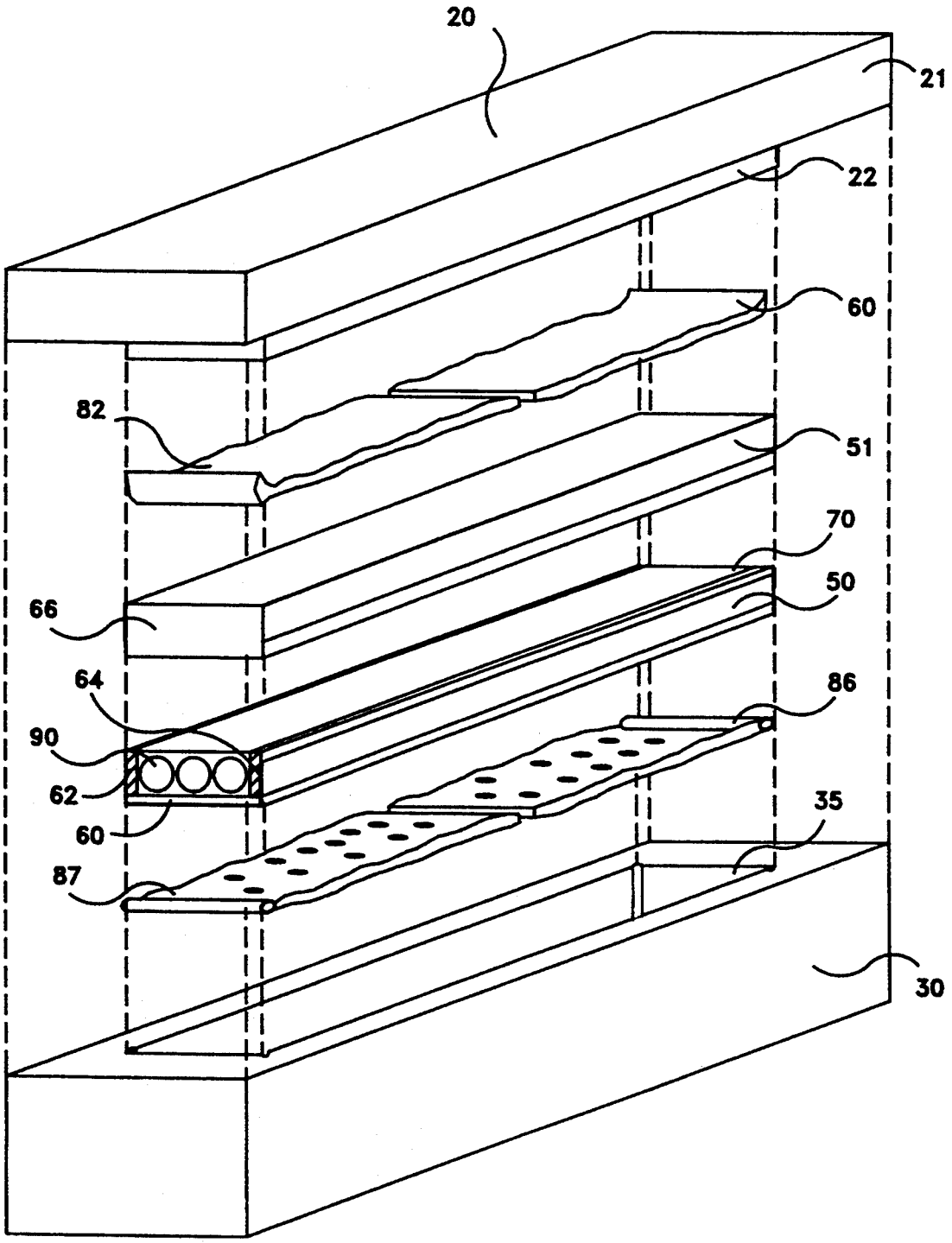
FIG. 4 is an expanded view of the elements and their relationship to each other according to the preferred embodiment of the present invention.

FIG. 4 shows an expanded view of the constant temperature storage container and illustrates the procedure for packing the container. A constant temperature source, such as ice water enclosed in sealed containers or bags 86, 87, is inserted in an inner cavity 35 of a frame 30 of an insulated material, such as expanded polystyrene. The lower heat regulator 60 is placed along the inside bottom of the lower U-shaped heat equalizer 50 and the storage box 70 containing an object 90 is placed directly on the heat regulator 60. The storage box 70 is maintained in position by spacers 62, 64 of insulated material on either side of the storage box 70 and next to the side walls of the heat equalizer 50. The heat equalizer 50, the heat regulator 60, the spacers 62, 64, and the storage box 70, are then inserted in the inner cavity 35 of the frame 30 directly onto the lower constant temperature coolant 86, 87. The upper heat regulator 66 and heat equalizer 51 are then inserted into the inner cavity 35 on top of the storage box 70. An upper constant temperature coolant, such as dry ice in denim bags 80, 82, is placed on top of the upper heat equalizer 51. Finally, the cap 20 is placed on frame 30 and secured in position.

Although FIGS. 1–4 illustrate the invention having one constant temperature storage box positioned between the coolant areas 40 and 41, one can also add to this a second storage box with suitable heat flow regulators above it and below it, in which case a two tier system would be made which is capable of storing two commodities at two different constant temperatures between the fixed temperature of the coolants in the areas 40 and 41. This construction is shown in FIG. 5.

Figure 5:
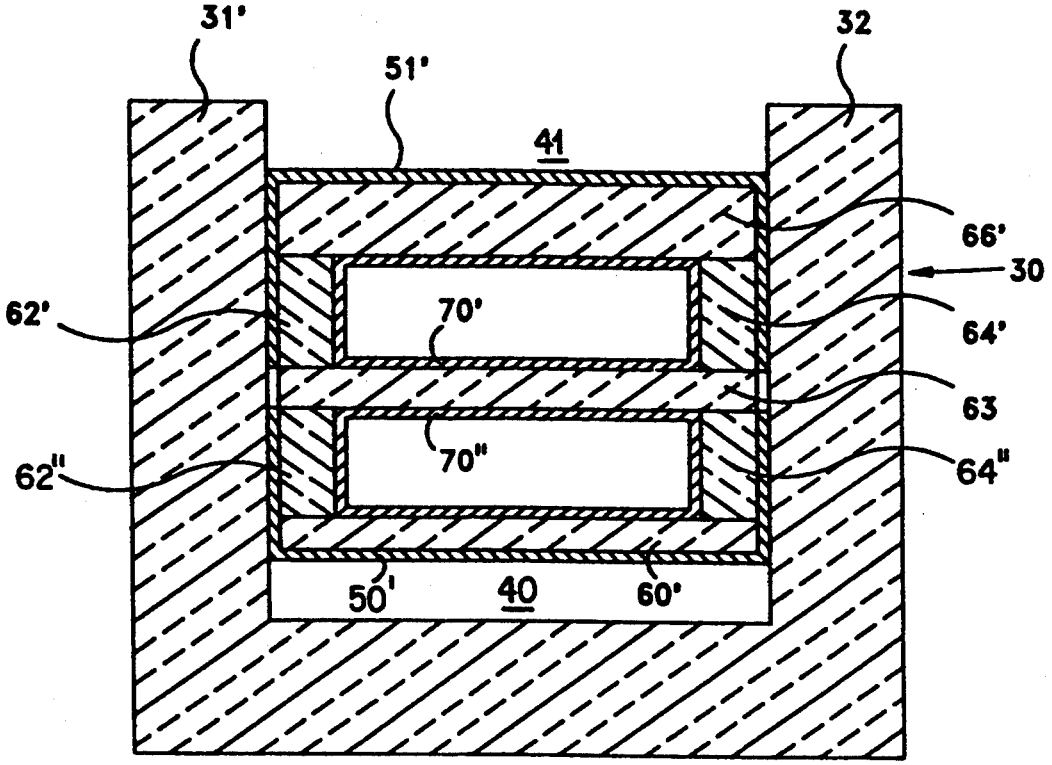
FIG. 5 is a cross-sectional view of a modified embodiment of the invention.

As shown in FIG. 5 two constant temperature boxes 70′, 70″, are provided, each formed of a good thermally conductive material such as aluminum. In this embodiment a first heat equalizer 5040 is disposed adjacent to a lower constant temperature source area 40 while a second heat equalizer 51′ is located adjacent to the upper constant temperature sink area 41. Both heat equalizers are made of a good thermally conductive material such as aluminum. Heat flow regulators 60′, 66′ are formed of an insulating material and are respectively disposed next to the heat equalizers 50′ and 51′. An additional heat flow regulator 63 formed of an insulating material is disposed between the constant temperature boxes 70′ and 70″. The insulating materials and/or thickness of heat flow regulators 60′, 66′ and 63 are chosen to provide respective, different desired constant temperatures for the storage boxes 70′ and 70″. The assembly is provided within frame 30 of insulating material such as expanded polystyrene and the frame 30 is covered with a cap 20, e.g., of expanded polystyrene, as shown in FIG. 1 Insulating spacers 62′, 64′, 62″, 64″ are used to maintain the position of storage boxes 7040 and 70″.

The FIG. 5 embodiment provides two constant temperature storage boxes 70′, 70″ which are easily maintained at two different selected constant temperatures which are between the temperatures of the coolants provided in the constant temperature source area 40 and the constant temperature sink area 41. The reader will recognize that three or more storage boxes can be maintained at different (constant) temperatures by modification of the embodiment shown in FIG. 5.

Although preferred embodiments have been specifically illustrated and described herein, it will be appreciated that many modifications can be made without departing from the spirit and scope of the invention. Accordingly, the invention is not limited by the foregoing description, but is only limited by the scope of the appended claims.

What is claimed is:

1. A constant temperature container, comprising:

a first constant temperature coolant for maintaining a first temperature;

a second constant temperature coolant for maintaining a second temperature different from said first temperature;

a first constant temperature storage area disposed between said first constant temperature coolant and said second constant temperature coolant;

a first insulating member separating said first constant temperature coolant and said constant temperature storage area; and a second insulating member separating said second constant temperature coolant and said constant temperature storage area, said first constant temperature storage area maintaining a constant temperature between said first and second temperatures determined by said first and second insulating members.

2. The container of claim 1, wherein said constant temperature of said storage area is maintained by conduction of heat through said first and second insulating members, such that said constant temperature is determined by the selected thicknesses of said first and second insulating members.

3. The container of claim 2, wherein said constant temperature T is determined by the thicknesses of said first and second insulating members according to the formula $$T=T_2-[x_2*(T_2-T_1))/(x_1+x_2)],$$

where $T_1$ and $T_2$ are said first and second temperatures and $x_1$ and $x_2$ are the respective thicknesses of the first and second insulating members, both of which are made of the same material.

4. The container of claim 1, further comprising a box of an insulated material enclosing said first and second constant temperature coolants, said first constant temperature storage area, and said first and second insulating members.

5. The container of claim 4, wherein said box includes:

an insulated frame defining an inner cavity; and an insulated cap which rests on said insulated frame and includes a portion which extends into said inner cavity.

6. The container of claim 5, further comprising:

a gas passage formed at the contact surfaces of said insulated frame and said insulated cap.

7. The container of claim 1, further comprising:

a first heat equalizer disposed between said first constant temperature coolant and said first insulating member; and a second heat equalizer disposed between said second constant temperature coolant and said second insulating member.

8. The container of claim 7, wherein said first heat equalizer and said second heat equalizer are made of a thermally conductive material.

9. The container of claim 8, wherein said first heat equalizer and said second heat equalizer are made of aluminum.

10. The container of claim 7, wherein said first and second heat equalizers each include:

a flat base; and two substantially parallel sidewalls extending from opposite sides and substantially perpendicular to said flat base.

11. The container of claim 1, wherein said first constant temperature storage area is defined by a box having sidewalls of a thermally conductive material.

12. The container of claim 11, wherein said box is made of aluminum.

13. The container of claim 1, wherein said first constant temperature coolant is a mixture of ice and liquid water.

14. The container of claim 13, wherein said second constant temperature coolant is solid carbon dioxide (dry ice).

15. The container of claim 1, wherein said container defines an inner cavity, with said coolants, said storage area, and said insulating members being located within said inner cavity, said container being arranged such that substantially no heat convection occurs within said inner cavity.

16. The container of claim 1, wherein said first constant temperature coolant uniformly maintains said first temperature for an extended period of time, and wherein said second constant temperature coolant uniformly maintains said second temperature for said extended period of time.

17. The container of claim 16, wherein said second constant temperature coolant is solid carbon dioxide (dry ice).

18. A cold storage container, comprising:

an insulated box defining an inner cavity;

a first cooling area including a first coolant at a first temperature in said inner cavity;

a second cooling area including a second coolant at a second temperature in said inner cavity;

a first constant temperature area defined between said first cooling area and said second cooling area;

a first insulating member of a first thickness separating said first cooling area from said constant temperature area; and a second insulating member of a second thickness separating said second cooling area from said constant temperature area.

19. The container of claim 18, wherein a temperature of said first constant temperature area is determined by the selected thicknesses and thermal properties of said first and second insulating members, and wherein the container is arranged such that the temperature of said first constant temperature area is maintained by conduction through said first and second insulating members, such that the temperature of said first constant temperature area is maintained at a temperature that is between said first and second temperatures.

20. The container of claim 19, wherein said temperature T of said first constant temperature area is determined by the selected thicknesses of said first and second insulated members according to the formula $$T = T_2 - [x_2 * (T_2 - T_1))/(x_1 + x_2)],$$

where $T_1$ and $T_2$ are said first and second temperatures and $x_1$ and $x_2$ are the respective thicknesses of the first and second insulating members, both of which are made of the same material.

21. The container of claim 18, wherein said first coolant is a mixture of ice and liquid water.

22. The container of claim 21, wherein said second coolant is solid carbon dioxide (dry ice).

23. The container of claim 18, wherein said second coolant is solid carbon dioxide (dry ice).

24. The container of claim 18, wherein said first constant temperature area is defined by a box having sidewalls of a thermally conductive material.

25. The container of claim 24, wherein said box is made of aluminum.

26. The container of claim 18, further comprising:

a first heat equalizer disposed between said first coolant area and said first insulating member; and a second heat equalizer disposed between said second coolant area and said second insulating member.

27. The container of claim 26, wherein said first and second heat equalizers are U-shaped.

28. The container of claim 26, wherein said first and second heat equalizers are made of aluminum.

29. The container of claim 18, wherein said insulated box includes:

an insulated frame defining said inner cavity; and an insulated cap which rests on said insulated frame and includes a portion which extends into said inner cavity.

30. The container of claim 29, further comprising:

a gas passage formed at the contact surfaces of said insulated frame and said insulated cap.

31. The container of claim 1 further comprising:

a second constant temperature storage area disposed between said first constant temperature coolant and said second constant temperature coolant; and a third insulating member provided between said first and second constant temperature storage areas.

32. The container of claim 18 further comprising:

a second constant temperature storage area disposed between said first constant temperature coolant and said second constant temperature coolant; and a third insulating member provided between said first and second constant temperature storage areas.

33. The container of claim 2, wherein said constant temperature T is determined by the materials composition and thickness of said first and second insulating members according to the formula $$T = T_2 - [(K_1X_2)(T_2 - T_1)/(K_2X_1 + K_1X_2)$$

where $K_1$ and $K_2$ are the respective thermal conductivities of the insulating members and $X_1$ and $X_2$ are the respective thickness of the insulating members, where $K_1$ does not equal $K_2$.

34. The container of claim 19, wherein said temperature of said first constant temperature area is determined by the materials composition and thickness of said first and second insulation members according to the formula $$T = T_2 - [(K_1X_2)\,(T_2 - T_1)/(K_2X_1 + K_1X_2)$$

where $K_1$ and $K_2$ are the respective thermal conductivities of the insulating members and $X_1$ and $X_2$ are the respective thickness of the insulating members, where $K_1$ does not equal $K_2$.

* * * * *